US008632159B2

(12) United States Patent
Masuda

(10) Patent No.: US 8,632,159 B2
(45) Date of Patent: Jan. 21, 2014

(54) MIST COLLECTION DEVICE AND LIQUID EJECTION DEVICE

(71) Applicant: Seiko Epson Corporation, Tokyo (JP)

(72) Inventor: Norihiro Masuda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/772,962

(22) Filed: Feb. 21, 2013

(65) Prior Publication Data

US 2013/0229460 A1 Sep. 5, 2013

(30) Foreign Application Priority Data

Mar. 5, 2012 (JP) ..... 2012-047694

(51) Int. Cl.
*B41J 2/165* (2006.01)

(52) U.S. Cl.
USPC ..... 347/34; 347/89

(58) Field of Classification Search
USPC ..... 347/29, 30, 34, 36, 89, 90
See application file for complete search history.

(56) References Cited

U.S. PATENT DOCUMENTS 4,847,637 A * 7/1989 Watanabe et al. ..... 347/30
5,266,975 A * 11/1993 Mochizuki et al. ..... 347/23
2011/0069115 A1 3/2011 Tanabe et al.

FOREIGN PATENT DOCUMENTS

JP 2011-062982 A 3/2011

* cited by examiner

*Primary Examiner* — Thinh Nguyen
(74) *Attorney, Agent, or Firm* — Global IP Counselors, LLP

(57) ABSTRACT

A mist collection device is adapted to collect a mist of liquid generated by ejecting the liquid from nozzles. A suction section of a suction container includes a suction port having an elongated shape whose length in an arrangement direction of the nozzles is greater than a width in a direction perpendicular to the arrangement direction. A tube section of the suction container is in communication with the suction section and having a hollow tube shape whose longitudinal direction is parallel to the arrangement direction. An outlet section of the suction container is in communication with an inside of the tube section through a discharge port formed at a lower part of the tube section. A collection container collects the mist by turning it into liquid droplets. A suction device generates an air flow flowing from the suction container to the collection container.

6 Claims, 2 Drawing Sheets

MIST COLLECTION DEVICE AND LIQUID EJECTION DEVICE

CROSS-REFERENCE TO RELATED APPLICATIONS

This application claims priority to Japanese Patent Application No. 2012-047694 filed on Mar. 5, 2012. The entire disclosure of Japanese Patent Application No. 2012-047694 is hereby incorporated herein by reference.

BACKGROUND

1. Technical Field

The present invention relates to a mist collection device that collects a mist of liquid generated by ejecting liquid from a nozzle, and a liquid ejection device.

2. Related Art

A printer in which a mist is sucked into a recovery device is known (see Japanese Laid-Open Patent Publication No. 2011-62982). In Japanese Laid-Open Patent Publication No. 2011-62982, the mist sucked into the recovery device is collected in a filter.

SUMMARY

In the above mentioned publication, however, ink that has turned into liquid droplets in the recovery device adheres to the filter or remains in the recovery device, which causes deterioration of the suction force into the recovery device.

The present invention has been made to address the above-described circumstances, and an object of the present invention is to provide a technique for preventing liquid that has turned into liquid droplets from impeding collection of a mist.

In order to achieve the above-described object, a mist collection device of one aspect is adapted to collect a mist of liquid generated by ejecting the liquid from a plurality of nozzles in an ejection head, and includes a suction container, a collection container and a suction device. The suction container includes a suction section, a tube section and an outlet section. In the suction section, a suction port is formed with the suction port being an opening having an elongated shape whose length in an arrangement direction of the nozzles is greater than a width in a direction perpendicular to the arrangement direction. The tube section is in communication with the suction section and having a hollow tube shape whose longitudinal direction is parallel to the arrangement direction. The outlet section is in communication with an inside of the tube section through a discharge port formed at a lower part of the tube section with respect to a vertical direction. The collection container is configured and arranged to collect the mist by turning the mist into liquid droplets. The suction device is configured and arranged to generate an air flow flowing from the suction container to the collection container.

In the above-described configuration, air containing a mist of liquid generated by ejecting liquid with a plurality of nozzles can be sucked by the suction section through the suction port. Air containing a mist sucked by the suction section is introduced into the tube section, and flows through the tube section. When air containing a mist flows through the tube section and collides with a wall surface of the tube section, the mist turns into liquid droplets, and liquid as the liquid droplets flows down toward a lower part in the vertical direction due to the gravity. Turning a mist into liquid droplets means that a mist adhering to the wall surface aggregates and has a volume of a prescribed value or more. Since the discharge port is formed at the lower part of the tube section in the vertical direction, liquid flowing down toward the lower part in the vertical direction within the tube section can be introduced from the discharge port to the outlet section together with air containing a mist. Liquid introduced to the outlet section together with air containing a mist is introduced to the collection container, and thus, the collection container can collect liquid that has turned into liquid droplets in the tube section together with air containing a mist. Accordingly, it is possible to prevent liquid that has turned into liquid droplets until it reaches the collection container from impeding collection of a mist.

The discharge port for discharging liquid that has turned into liquid droplets from the tube section may be formed at a lower part of the vertical direction in a lid section for closing the tube section from an end in the longitudinal direction of the tube section. With this, the outlet section that connects the collection container and the tube section can be disposed around the outside of the tube section in the longitudinal direction. Therefore, even in a case where a plurality of ejection heads are arranged such that the arrangement directions of the nozzles are in parallel with respect to each other, the outlet section can be disposed around the outside of the tube section in the longitudinal direction (the arrangement direction of the nozzles), and thus the outlet section can be formed so as not to interfere with the ejections heads. If the discharge port is formed in the lid section at an end of the tube section in the longitudinal direction, the suction force from the discharge port possibly becomes non-uniform in the longitudinal direction of the tube section. However, it is possible to prevent the suction force from becoming non-uniform in the longitudinal direction by increasing the volume of the tube section. The discharge port may be disposed at both ends of the tube section in the longitudinal direction, or may be disposed at only one end.

Further, the lid section may be formed such that the discharge port moves by rotation along an end surface of the tube section in the longitudinal direction. With this, even when the attachment angle of the tube section with respect to the mist collection device varies, the discharge port can be located at the lower part of the tube section in the vertical direction. Accordingly, there is no need to prepare the lid section for each attachment angle of the tube section with respect to the mist collection device. Incidentally, when the tube section has a cylindrical shape, and the end surface of the tube section in the longitudinal direction and the lid section have a circular shape, the position of the discharge port can be adjusted continuously. When the tube section has an N-sided equilateral polygonal prism shape (N is an integer of 3 or more), and the end surface of the tube section in the longitudinal direction and the lid section have an N-sided polygonal shape, the position of the discharge port can be adjusted at N stages.

Further, the suction section and the tube section may be connected with each other such that a direction of an air flow in the suction section is a tangential direction of a cross-section perpendicular to the longitudinal direction of the tube section. With this, air from the suction section can be introduced along the wall surface of the tube section, and the direction of an air flow can be changed gradually along the wall surface of the tube section. Therefore, pressure loss inside the tube section can be controlled. When air flows along the wall surface of the tube section, a mist easily turns into liquid droplets on the wall surface of the tube section. In such a case, however, liquid droplets generated on the wall surface can be collected in the collection container through the discharge port.

Furthermore, the suction section may be configured such that the length in the arrangement direction of the plurality of nozzles is greater than the length in an arrangement direction of the ejection head.

Further, the technique for collecting a mist according to the present invention can be implemented as a method. Also, the above-described device or method can be implemented as a single device, or can be implemented by being incorporated into a device having a complex function. More specifically, the present invention can be applied to a liquid ejection device that has a plurality of ejection heads disposed at different angles with respect to each other. In such a case, a discharge port may be formed at the lower part of the tube section in the vertical direction in each of a plurality of suction containers disposed corresponding to each of the plurality of ejection heads disposed at different angles with respect to each other. In sum, the position of the discharge port may be adjusted in each suction container.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, embodiments of the present invention will be explained in the following order: (1) Configuration of Printer; (2) Configuration of Mist Collection Device; and (3) Modified Embodiment.

(1) Configuration of Printer

Figure 1:
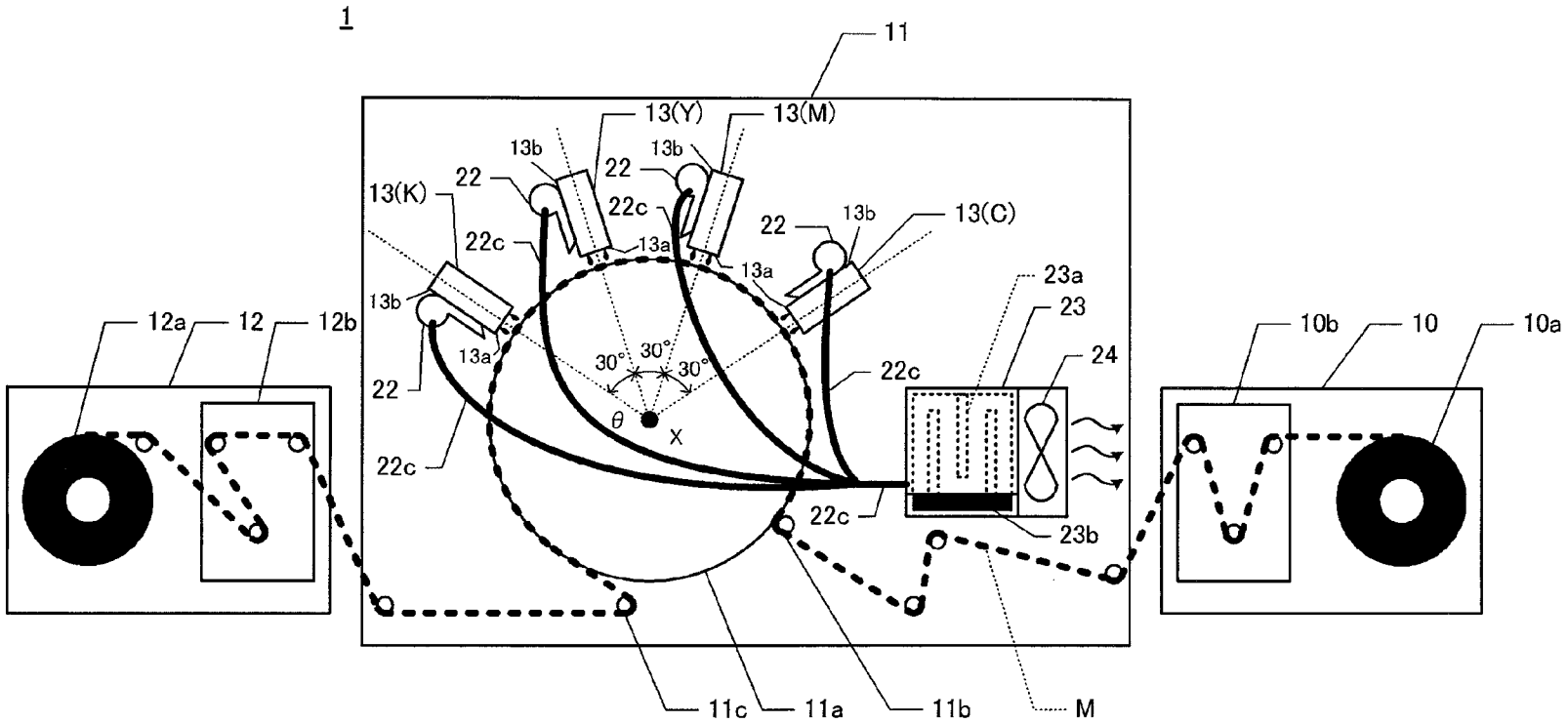
FIG. 1 is a block diagram of a printer.

FIG. 1 is a block diagram showing a configuration of a printer 1 as a liquid ejection device including a mist collection device according to an embodiment of the present invention. The printer 1 has a feed section 10, a print section 11, a recovery section 12, and an ejection head 13. The feed section 10 has a feed reel 10*a* and a tension adjustment section 10*b*. A roll of paper M (thick broken line) is rolled around a roll core of the feed reel 10*a*, and the roll of paper M is reeled out by rotating the feed reel 10*a* around a central axis of the roll core. The tension adjustment section 10*b* has a roller biased to exert prescribed tension on the roll of paper M between the feed reel 10*a* and the print section 11.

The print section 11 has a drum 11*a*, a feed-in roller 11*b*, and a feed-out roller 11*c*. The drum 11*a* is formed to have a cylindrical shape or an elliptic cylindrical shape, and rotates around a central axis X. The feed-in roller 11*b* is a roller for introducing a roll of paper M fed from the feed section 10 to the drum 11 a in a tangential direction of the side surface of the drum 11*a*. The feed-out roller 11*c* is a roller for introducing out a roll of paper M retained on the side surface of the drum 11*a* in the tangential direction of the side surface of the drum 11*a*. When the drum 11*a* rotates counterclockwise with respect to the drawing, a roll of paper M can be retained on the side surface of the drum 11*a*, and a roll of paper M can be delivered from the feed section 10 to the recovery section 12.

The recovery section 12 has a recovery reel 12*a* and a tension adjustment section 12*b*. A roll of paper M is rolled around a roll core of the recovery reel 12*a*,and the roll of paper M is reeled in by rotating the recovery reel 12*a* around the central axis of the roll core. The tension adjustment section 12*b* has a roller biased to exert prescribed tension on the roll of paper M between the recovery reel 12*a* and the print section 11.

The ejection head 13 is provided for each kind of ink as liquid. In the present embodiment, the ejection head 13 is provided for each of C (cyan), M (magenta), Y (yellow), and K (black). Each of the ejection heads 13 has a similar configuration, and is disposed to have rotation symmetry with respect to the central axis X of the drum 11*a*. Each of the ejection heads 13 has a nozzle surface 13*a* to face a roll of paper M retained on the side surface of the drum 11*a*. A plurality of nozzles are arranged in a surface of the nozzle surface 13*a*. Ink is ejected from the plurality of nozzles toward a roll of paper M retained on the side surface of the drum 11*a*. In each of the four ejection heads 13, a direction of ejecting ink is a direction toward the central axis X of the drum 11*a*. The ejecting directions θ with respect to the central axis X in the ejection heads 13 are different from each other by 30 degrees.

(2) Configuration of Mist Collection Device

The printer 1 as a configuration of the mist collection device for collecting a mist of ink has a suction container 22, a collection container 23, and a suction fan 24. The suction container 22 is provided corresponding to each of the ejection heads 13, and is disposed adjacent to each of the ejection heads 13. The suction container 22 is disposed adjacent to a vertical wall surface 13*b* (wall surface perpendicular to the nozzle surface 13*a*) of each of the ejection heads 13 from below. Specifically, the suction container 22 is adjacent to the vertical wall surface 13*b* of each of the ejection heads 13 (C, M, Y and K) from the clockwise direction with respect to the drawing. More specifically, the suction container 22 is adjacent to the vertical wall surface 13*b* of each of the ejection heads 13 from the downstream of a direction of feeding a roll of paper M.

Air inside the collection container 23 is sucked by driving the suction fan 24 as the suction device. Each of the plurality of the suction containers 22 is connected to the single collection container 23, and air inside each of the suction containers 22 is collected into the collection container 23. A collection wall 23*a* (broken like) is formed inside the collection container 23. When a mist of ink contained in air inside the collection container 23 collides with the collection wall 23*a*, the mist of ink is turned into liquid droplets. A reservoir section 23*b* is provided at a lower part of the collection container 23 in the vertical direction. Ink that has been turned into liquid droplets flows down to the reservoir section 23*b*, and is stored in the reservoir section 23*b*. For example, the reservoir section 23*b* may be removable from the main body of the collection container 23, and the reservoir section 23*b* can be replaced or cleaned by removing the reservoir section 23*b* from the collection container 23.

Figure 2:
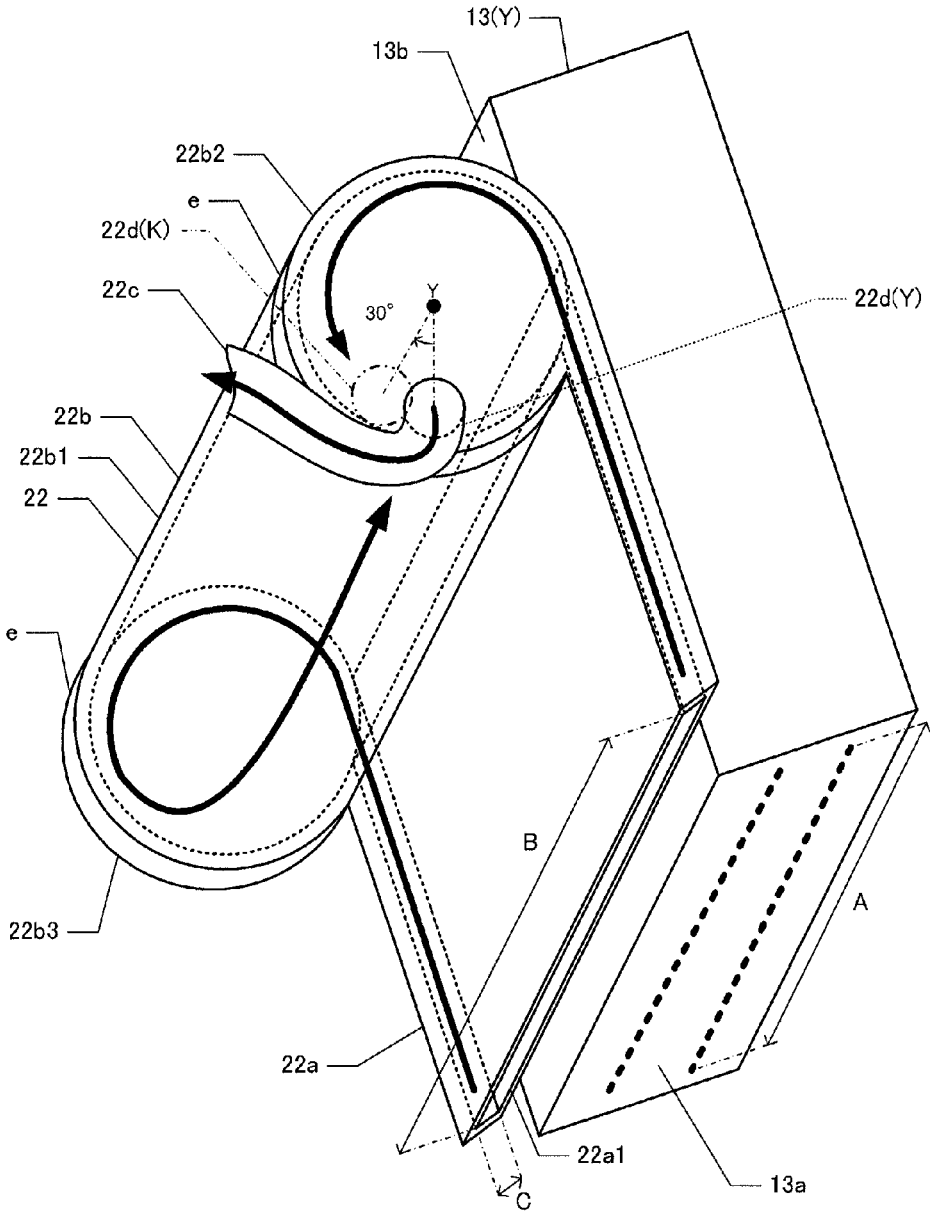
FIG. 2 is a perspective view of a suction container.

FIG. 2 is a perspective view of the suction container 22 provided corresponding to the ejection head 13 (Y) for Y ink. The suction container 22 has a suction section 22*a*, a hollow member 22*b*, and an outlet section 22*c*. The hollow member 22*b* corresponds to the tube section. In the present embodiment, two lines of nozzles (thick broken line) are provided on the nozzle surface 13*a* of each of the ejection heads 13, and the arrangement direction of the nozzles in the lines of nozzles is parallel to the central axis X of the drum 11*a*. Here, the length of the lines of nozzles is represented by A. The suction section 22*a* has a hollow shape in which the cross-section cut in parallel with the nozzle surface 13*a* has a prescribed rectangle shape. The length B of the internal space of the suction section 22*a* in the arrangement direction of the nozzles is greater than the length A of the lines of nozzles. The length C of the internal space of the suction section 22*a* in a direction perpendicular to the arrangement direction of the nozzles is smaller than the length B in the arrangement direction of the nozzles. Therefore, the internal space of the suction section 22*a* has an elongated shape that is long in the arrangement direction of the nozzles. An elongated opening that is long in the arrangement direction of the nozzles is formed at an upper end and a lower end of the suction section 22*a*, respectively. The opening at the lower end forms a suction port 22*a*1. In the internal space of the suction section 22*a*, air flows from the suction port 22*a*1 at the lower end toward the upper end. The direction of an air flow in the internal space of the suction section 22*a* is a direction opposite to the direction of ejecting ink in the ejection head 13. The air flow is schematically shown by a thick arrow.

The hollow member 22*b* is formed to have a cylindrical shape whose central axis Y is parallel to the arrangement direction of the nozzles. The upper end of the suction section 22*a* and the hollow member 22*b* are connected such that the direction of the air flow in the internal space of the suction section 22*a* coincides with the tangential direction of the side surface of the hollow member 22*b*. Consequently, air is introduced to the tangential direction of the side surface of the hollow member 22*b* through the opening at the upper end of the suction section 22*a*.

The hollow member 22*b* is constructed by a main body section 22*b*1, and two lid sections 22*b*2, 22*b*3. The main body section 22*b*1, and the lid sections 22*b*2, 22*b*3 are separate members, and are attached to each other when the printer 1 is assembled. The main body section 22*b*1 is an open tube in which the both ends in the longitudinal direction are opened. Each of the lid sections 22*b*2, 22*b*3 is formed to have a circular shape that is the substantially same shape as the cross-section of the hollow member 22*b* perpendicular to the longitudinal direction. An outer peripheral portion "e" is raised in the longitudinal direction of the hollow member 22*b* by a prescribed height. The inner diameters of the outer peripheral portions "e" of the lid sections 22*b*2, 22*b*3 are formed to have the same magnitude as the outer diameter of the main body section 22*b*1. The both ends of the main body section 22*b*1 in the longitudinal direction are fitted into the insides of the outer peripheral portions "e" of the lid sections 22*b*2, 22*b*3, and the lid sections 22*b*2, 22*b*3 are rotatably attached to the main body section 22*b* 1. A discharge port 22*d* having a circular shape is formed in the lid section 22*b*2 so as to internally contact the outer peripheral portion "e". When the lid section 22*b*2 rotates with respect to the main body section 22*b*1, the discharge port 22*d* moves in a circumferential direction along the end surface of the main body section 22*b*1 in the longitudinal direction.

As shown in FIG. 1, the ink ejecting direction θ with respect to the central axis X of the drum 11*a* is different from each other by 30 degrees, and the arrangement position of the hollow member 22*b* with respect to the vertical wall surface 13*b* in parallel with the ejecting direction θ is different for each of the ejection heads 13. However, irrespective of the angle of the vertical wall surface 13*b*, the lid section 22*b*2 is fixed to the main body section 22*b*1 in a state where the lid section 22*b*2 rotates such that the discharge port 22*d* is located at the lower end of the hollow member 22*b* in the vertical direction. The main body section 22*b*1 and the lid sections 22*b*2, 22*b*3 can be fixed by an adhesive, welding, screwing or the like. Further, a packing or the like may be interposed between the main body section 22*b*1 and the lid sections 22*b*2, 22*b*3 so as to achieve air tightness. Although a material for the main body section 22*b*1 and the lid sections 22*b*2, 22*b*3 is not limited to a specific one, a light shielding material is preferable in a case where ink is light curing ink.

In FIG. 2, the discharge port 22*d* (Y) of the hollow member 22*b* provided corresponding to the ejection head 13 (Y) for Y ink is shown by a broken line, and the discharge port 22*d* (K) of the hollow member 22*b* provided corresponding to the ejection head 13 (K) for C ink is shown by a two-dot chain line. As shown in FIG. 2, when comparing the discharge port 22*d* (Y) and the discharge port 22*d* (K) provided in the ejection head 13 (Y) and the ejection head 13 (K) whose ejecting directions θ are different from each other by 30 degrees, the arrangement positions of the discharge port 22*d* (Y) and the discharge port 22*d* (K) viewed from the central axis Y of the hollow member 22*b* are different from each other by 30 degrees.

The outlet section 22*c* is a tube having a circular cross-section. As shown in FIG. 1, the outlet section 22*c* connects each of the suction containers 22 (each of the discharge ports 22*d*) and the collection container 23. In the present embodiment, the outlet section 22*c* has four branches that connect to the discharge ports 22*d* of the suction containers 22, respectively. The four branches are merged into one, and then connected with the collection container 23.

In the configuration of the present embodiment described above, air containing a mist of liquid generated by ejecting ink from the plurality of nozzles can be sucked from the suction port 22*a*1 to the suction section 22*a*. Air containing a mist sucked to the suction section 22*a* is introduced to the hollow member 22*b*, and flows through the hollow member 22*b*. When air containing a mist flows through the hollow member 22*b* and collides with the wall surface of the hollow member 22*b*, the mist turns into liquid droplets, and ink that has turned into liquid droplets flows down toward the lower part in the vertical direction due to the gravity. Since the discharge port 22*d* is formed at the lower end of the hollow member 22*b* in the vertical direction, ink that flows down toward the lower part in the vertical direction within the hollow member 22*b* can be introduced from the discharge port 22*d* to the outlet section 22*c* together with air containing a mist. Since ink introduced to the outlet section 22*c* together with air containing a mist is introduced to the collection container 23, the collection container 23 can collect ink that has turned into liquid droplets in the hollow member 22*b* together with air containing a mist. Accordingly, it is possible to prevent collection of a mist from being obstructed by ink that has turned into liquid droplets until reaching the collection container 23.

The discharge port 22*d* for discharging ink that has turned into liquid droplets from the hollow member 22*b* is formed at the lower end in the vertical direction in the lid section 22*b*2 for closing the hollow member 22*b* from an end in the longitudinal direction. With this, the outlet section 22*c* that connects the collection container 23 and the hollow member 22*b* can be disposed around the outside of the hollow member 22*b* in the longitudinal direction. Therefore, even in a case where the plurality of ejection heads 13 are arranged such that the arrangement directions of the nozzles are in parallel with respect to each other, the outlet section 22*c* can be disposed around the outside of the hollow member 22*b* in the longitudinal direction (the arrangement directions of the nozzles), and thus the outlet section 22*c* can be formed so as not to interfere with the ejections heads 13. If the discharge port 22*d* is formed in the lid section 22*b*2 at the end of the hollow member 22*b* in the longitudinal direction, the suction force from the discharge port 22*d* possibly becomes non-uniform in the longitudinal direction of the hollow member 22*b*. However, it is possible to prevent the suction force from becoming non-uniform in the longitudinal direction by increasing the volume of the hollow member 22*b*.

Further, the lid section 22*b*2 is formed such that the discharge port 22*d* moves by rotation along an end surface of the hollow member 22*b* in the longitudinal direction. With this, even when the attachment angle of the hollow member 22*b* with respect to the printer 1 varies, the discharge port 22*d* can be located at the lower end of the hollow member 22*b* in the vertical direction. Accordingly, there is no need to prepare the lid section 22*b*2 for each attachment angle of the hollow member 22*b* with respect to the printer 1. In the present embodiment, although the attachment angle of the hollow member 22*b* with respect to the printer 1 is different for each kind of ink, the components (the main body section 22*b*1, and the lid sections 22*b*2, 22*b*3) of the hollow member 22*b* can be made in common irrespective of the kind of ink.

Further, the suction section 22*a* and the hollow member 22*b* are connected with each other such that the air flow direction in the suction section 22*a* is a tangential direction of a cross-section perpendicular to the longitudinal direction of the hollow member 22*b*, that is a side surface of the hollow member 22*b*. With this, air from the suction section 22*a* can be introduced along the side surface of the hollow member 22*b*, and the air flow direction can be changed gradually along the wall surface of the hollow member 22*b*. Therefore, pressure loss inside the hollow member 22*b* can be controlled. When air flows along the side surface of the hollow member 22*b*, a mist easily turns into liquid droplets on the side surface of the hollow member 22*b*. In such a case, however, liquid droplets generated on the side surface can be collected in the collection container 23 through the discharge port 22*d*.

Since the hollow member 22*b* has a cylindrical shape, ink that has turned into liquid droplets is caused to smoothly flow down toward the lower end in the vertical direction along the side surface of the hollow member 22*b*. Also, since the hollow member 22*b* has a cylindrical shape, the rotation angle of the lid section 22*b*2 with respect to the main body section 22*b*1 can be adjusted continuously, and the main body section 22*b*1 and the lid section 22*b*2 can be used for various kinds of printers 1.

(3) Modified Embodiment

In the above-described embodiment, the hollow member 22*b* has a cylindrical shape. However, the hollow member 22*b* may have an equilateral polygonal prism shape. In order to cause ink that has turned into liquid droplets to smoothly flow down toward the lower end in the vertical direction along the side surface of the hollow member 22*b*, it is preferable that the internal angle of the cross-section of the hollow member 22*b* is made as large as possible. Specifically, when the hollow member 22*b* has an equilateral polygonal prism shape, it is preferable that the shape is an equilateral polygonal prism having five sides or more so as to make the internal angle obtuse. Also, the discharge port 22*d* may be disposed at both ends of the hollow member 22*b* in the longitudinal direction.

In the above-described embodiment, the printer 1 ejects ink droplets. However, it is also possible to eject liquid other than ink droplets. Further, liquid may be ejected by applying pressure due to a mechanical change of a piezoelectric element, or may be ejected by applying pressure due to generation of air bubbles. Further, a medium to be recorded is not limited to printing paper, and may be cloth or a film made of resin, or the like. A medium to be recorded is not limited to one that is retained on the side surface of the drum, and may be retained on a platen having a flat shape. Further, the ejection heads do not need to be plural, and a single or a plurality of suction containers may be provided with respect to a single ejection head.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A mist collection device adapted to collect a mist of liquid generated by ejecting the liquid from a plurality of nozzles in an ejection head, the mist collection device comprising:

a suction container including a suction section in which a suction port is formed, the suction port being an opening having an elongated shape whose length in an arrangement direction of the nozzles is greater than a width in a direction perpendicular to the arrangement direction, a tube section in communication with the suction section and having a hollow tube shape whose longitudinal direction is parallel to the arrangement direction, and an outlet section in communication with an inside of the tube section through a discharge port formed at a lower part of the tube section with respect to a vertical direction;

a collection container configured and arranged to collect the mist by turning the mist into liquid droplets; and a suction device configured and arranged to generate an air flow flowing from the suction container to the collection container.

2. The mist collection device according to claim 1, wherein the discharge port is formed at a lower part of a lid section with respect to the vertical direction, the lid section being configured and arranged to close the tube section from an end in the longitudinal direction of the tube section.

3. The mist collection device according to claim 2, wherein the lid section is formed such that the discharge port moves by rotation along an end surface of the tube section in the longitudinal direction, and the lid section is fixed in a state where the discharge port is located at the lower part of the tube section in the vertical direction.

4. The mist collection device according to claim 3, wherein the suction section and the tube section are in communication with each other such that a direction of an air flow in the suction section is a tangential direction of an outer periphery of a cross-section of the tube section taken along a perpendicular direction to the longitudinal direction of the tube section.

5. The mist collection device according to claim 1, wherein a length of the suction section in the arrangement direction of the nozzles is greater than a length of the suction section in an arrangement direction of the ejection head.

6. A liquid ejection device comprising:

a plurality of ejection heads configured and arranged to eject liquid from a plurality of nozzles, the ejection heads being disposed at different angles with respect to each other;

a plurality of suction containers respectively disposed corresponding to the ejection heads at different angles with respect to each other, and configured and arranged to suck a mist of the liquid generated in each of the ejection heads;

a collection container in communication with each of the suction containers, and configured and arranged to collect the mist of the liquid by turning the mist of the liquid into liquid droplets; and a suction device configured and arranged to generate an air flow flowing from each of the suction containers to the collection container, wherein each of the suction containers includes a suction section in which a suction port is formed, the suction port being an opening having an elongated shape whose length in an arrangement direction of the nozzles is greater than a width in a direction perpendicular to the arrangement direction, a tube section in communication with the suction section and having a hollow tube shape whose longitudinal direction is parallel to the arrangement direction, and an outlet section configured and arranged to allow communication between an inside of the tube section and the collection container through a discharge port formed at a lower part of the tube section with respect to a vertical direction.

* * * * *